US005515248A

United States Patent [19]

Canfield et al.

[11] Patent Number: 5,515,248

[45] Date of Patent: May 7, 1996

[54] THIN ADHESIVELY ATTACHED KEY LIGHT DEVICE

[76] Inventors: Madeline M. Canfield, 8101 E. Bellevue, Tucson, Ariz. 85715; Paul C. Mioduski, 3470 N. Olsen Ave., Tucson, Ariz. 85719

[21] Appl. No.: 489,107

[22] Filed: Jun. 9, 1995

[51] Int. Cl.[6] ..... F21V 33/00

[52] U.S. Cl. ..... 362/116; 362/100; 362/195; 362/201; 362/800

[58] Field of Search ..... 362/116, 100, 362/119, 194, 195, 200, 201, 800

[56] References Cited

U.S. PATENT DOCUMENTS

| | | | |
|---|---|---|---|
| 3,085,149 | 4/1963 | Giwosky | 240/6.4 |
| 3,256,428 | 6/1966 | Schwartz | 240/10.65 |
| 3,310,668 | 3/1967 | Schwartz | 240/6.4 |
| 3,613,414 | 10/1971 | Ostrager | 362/116 |
| 4,085,315 | 4/1978 | Wolter et al. | 362/116 |
| 4,276,582 | 6/1982 | Burnett | 362/116 |
| 4,303,966 | 12/1981 | Wolter | 362/116 |
| 4,392,186 | 7/1983 | Cziment | 362/116 |
| 4,521,833 | 6/1985 | Wolter | 362/116 |
| 4,692,846 | 9/1987 | Johnson | 362/201 |
| 4,787,016 | 11/1988 | Song | 362/116 |
| 4,964,023 | 10/1990 | Nishizawa et al. | 362/116 |
| 5,386,351 | 1/1995 | Tabor | 362/201 |

*Primary Examiner*—Denise L. Gromada
*Assistant Examiner*—Alfred Basichas
*Attorney, Agent, or Firm*—Cahill, Sutton & Thomas

[57] ABSTRACT

A thin, disposable key light device that is adhesively attachable to the head of a key includes a light emitting diode, a disk battery, an insulative annular spacer, and an adhesive disk. A lead of the light emitting diode extends over a hole in the annular spacer. Leads of the light emitting diode straddle the battery and annular spacer. Switch actuation pressure applied to a flexible housing elastically deforms one of the leads through the hole in the annular spacer, causing that lead to electrically contact one electrode surface of the battery and thereby connect the light emitting disk in series with the battery.

19 Claims, 2 Drawing Sheets

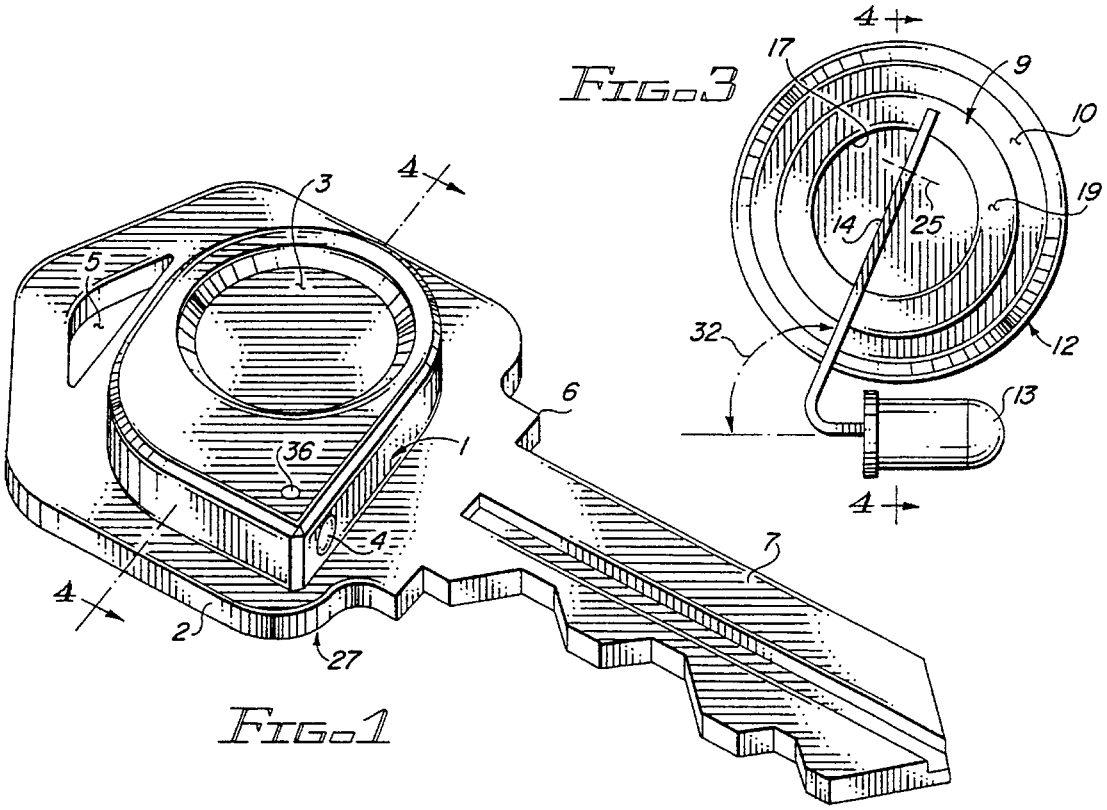
FIG. 3
FIG. 1
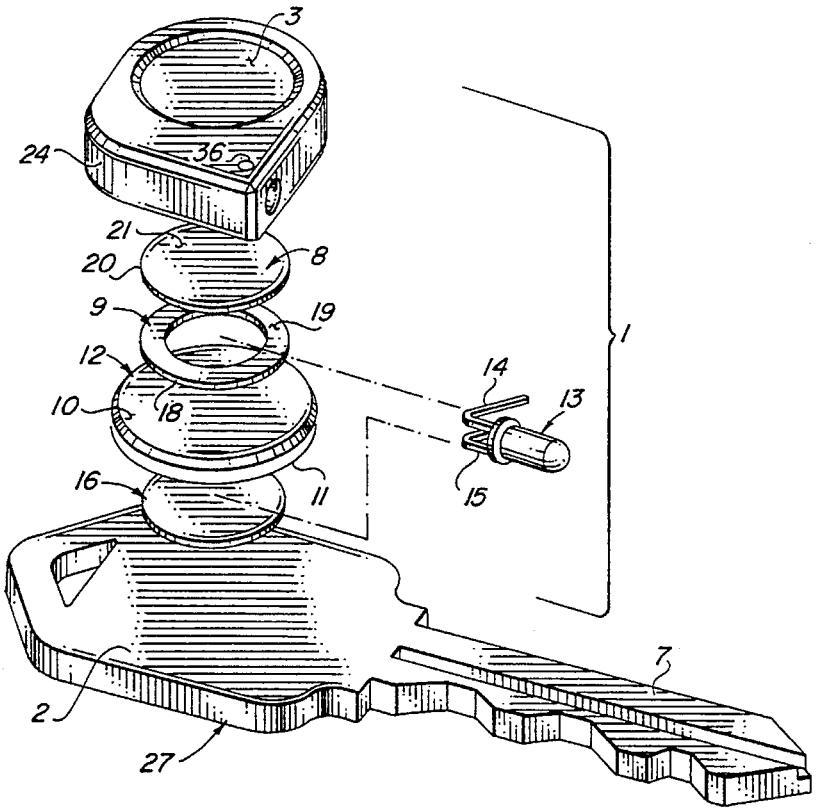
FIG. 2

THIN ADHESIVELY ATTACHED KEY LIGHT DEVICE

BACKGROUND OF THE INVENTION (a) Field of the Invention

The present invention relates to a thin light source which is adhesively attachable to various keys or other objects.

(b) Description of Prior Art

There are many lighting devices which may be attached to keys and other objects. The prior devices have various drawbacks. Many key mounted lights can not be used with industry standard key blanks. U.S. Pat. Nos. 3,085,149 (Giwosky), 4,276,582 (Burnett) and 4,392,186 (Cziment) show examples of key light devices which can not be attached to most ordinary existing keys. Even key light devices which can be attached to standard keys, such as the light devices disclosed in U.S. Pat. Nos. 3,085,149 (Giwosky), 3,310,668 (Schwartz), 3,256,428 (Schwartz), 4,085,315 (Wolter) and 4,787,016 (Song), are limited to specific key head configurations, thicknesses, or sizes.

Some key light devices, such as those disclosed in U.S. Pat. Nos. 3,310,668 (Schwartz), 3,256,428 (Schwartz), 4,085,315 (Wolter) and 4,787,016 (Song), require use of a screwdriver to secure such key light devices to a key head. Some such key light devices include pieces which are easily dislodged or lost during installation.

None of the known key light devices are small enough that when they are attached to a key, it can fit into an ordinary key case. Multiple keys with such prior key light devices attached can not be attached to an ordinary size key ring. It is impractical to attach the known key mounted light devices to objects other than keys.

SUMMARY OF THE INVENTION

Accordingly, it is an object of the invention to provide a thin, inexpensive, discardable lighting device which is adhesively attachable to various objects, especially to heads of ordinary keys such as house keys and auto ignition keys.

It is another object of the invention to provide a thin key light device which can be adhesively attached to keys made with industry standard key blanks.

It is another object of the invention to provide a lighting device which is easily attached to keys and other objects without the use of any tools.

It is another object of the invention to reduce the cost, size and complexity of a key light device by reducing the number of components needed.

It is another object of the invention to provide a key light device which is small enough that keys with the key light device attached are small enough to fit into ordinary key cases or to allow several keys with the key light devices attached to be carried on an ordinary key ring.

It is another object of the invention to provide a key light device attachable to a conventional key and small enough that the key with the key light device attached can fit into a standard key case without risk of accidental illumination of the device during ordinary handling of the key case.

Briefly described, and in accordance with one embodiment thereof, the invention provides an exceptionally compact light which is easily adhesively attached to standard size keys or to other objects. The preferred embodiment includes a flexible enclosure which covers the battery and other components. A light emitting diode (LED) is used as a light source. A first lead of the LED is in direct contact with a first electrode surface of the battery. A second lead of the LED is used as part of a switch mechanism, in combination with a first electrode surface of a disk battery and an insulative spacer which supports the second lead a short distance from the second electrode surface. To actuate the key light device, the flexible enclosure is squeezed to elastically deform the second lead, causing it to electrically contact the second electrode surface. The battery has an internal resistance which limits the current in the LED to a value that causes generally optimum illumination of a region in front of the key. The first electrode surface of the battery is attached to a key or other object by means of a double-sided adhesive pad.

BRIEF DESCRIPTION OF THE DRAWINGS

FIG. 1 is a perspective view of the preferred embodiment of the key light device of the present invention mounted to a key.

FIG. 2 is an exploded perspective view of the preferred embodiment of FIG. 1.

FIG. 3 is a top view of a portion of the key light device.

DETAILED DESCRIPTION OF THE PREFERRED EMBODIMENTS

Figure 4:
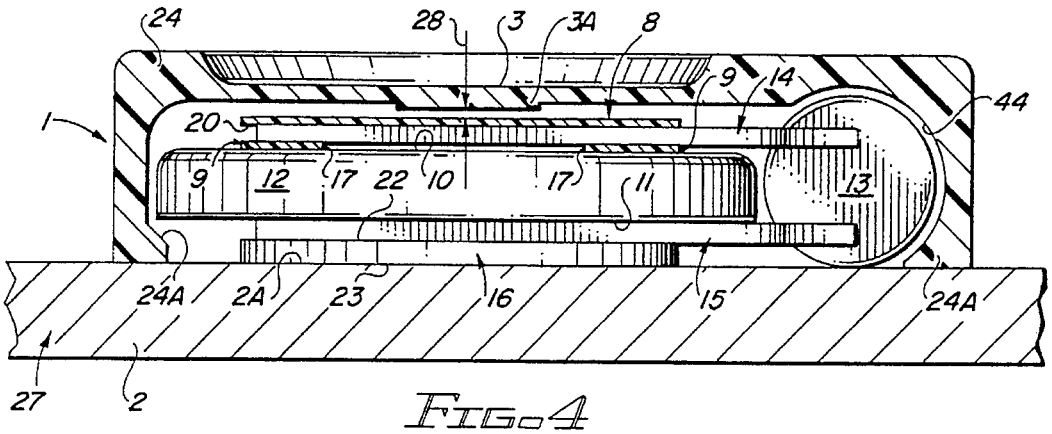
FIG. 4 is a cross-sectional view along section line 4—4 of FIGS. 1 and 3.
Figure 5:
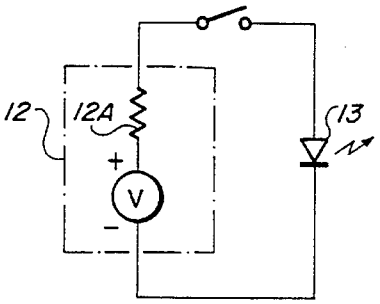
FIG. 5 is a circuit diagram showing an equivalent circuit of the battery (including its internal resistance) and light emitting diode 9, and is useful in describing the operation and benefits of the invention.

Referring to FIGS. 1–5, the assembled key light 1 is attached to a key head 2 oriented such that an LED light aperture 4 directs light along a key shaft 7 when a switch actuation surface 3 of the enclosure 24 of key light 1 is depressed. An optional LED light aperture 36 may be provided to allow light from the subsequently described LED to pass perpendicularly to the face of key head 2. Key light 1 is positioned as illustrated on the key head 2 between hole 5 of key head 2 and edge 6 of key shaft 7 such that key light 1 does not interfere either with attachment of the key to a key ring or insertion of the key into a lock.

A lower surface 18 of an annular spacer 9 is coated with adhesive and is attached to the upper surface 10 of a battery 12. The upper lead 14 and lower lead 15 of an LED (light emitting diode) 13 "straddle" the combination of spacer 9 and battery 12, as shown in FIGS. 3 and 4. Upper lead 14 of LED 13 contacts the upper surface 19 of spacer 9, and spans hole 17 of annular spacer 9, as shown in FIG. 3. Lower lead 15 of LED 13 contacts the lower surface 11 of battery 12. Double-sided adhesive pad 16 thereby attaches the lower surface 11 of battery 12 to the upper surface 2A of key head 2. As shown in FIG. 3, the outer portions of leads 14 and 15 are bent at an angle 32 of approximately 110 degrees (i.e., generally perpendicularly) relative to the cylindrical axis of LED 13, in order to minimize the overall size of key light device 1.

Referring to FIGS. 2 and 4, the lower surface 20 of a flexible disk 8 is coated with adhesive which holds upper lead 14 of LED 13 in the illustrated position relative to annular spacer 9, and also acts as a seal to prevent foreign material such as dust from entering and interfering with the operation of key light device 1. Although not shown in FIG. 4, flexible adhesive disk 8 conforms to and adheres to both upper lead 14 and the upper electrode surface 10 of battery 12.

Upper lead 14 of LED 13, annular spacer 9, and upper electrode surface 10 of battery 12 form a switch that controls the flow of current from the battery 12 through LED 13. Flexible enclosure 24 as shown in FIGS. 2 and 4 snaps over the complete assembly consisting of sealing disk 8, annular spacer 9, battery 12, LED 13 and adhesive pad 16. Snap-on lip 24A of flexible housing 24 surrounds approximately 270 degrees of the perimeter of battery 12, thereby providing snap-on attachment of flexible enclosure 24 to battery 12 (which is adhesively attached to key head 2). The upper portion of flexible enclosure 24 includes a thickened section or protrusion 3A which transfers pressure applied at switch actuation surface 3 through sealing disk 8 to force upper lead 14 of LED 13 against upper electrode surface 10 of battery 12 to close the switch. Protrusion 3A thereby reduces the pressure required on area 3 to actuate the switch formed by upper LED lead 14, the upper electrode surface 10 of battery 12, and annular spacer 9. Gap 28 is approximately 0 to 2 mils in the described embodiments.

In a prototype we have constructed, battery 12 is a Model CR1220, marketed by Renata, which is a three volt lithium cell having a shelf life of approximately 10 years. This battery has an internal resistance 12A (See FIG. 5) of approximately 56 ohms. In accordance with the present invention, internal resistance 12A of battery 12 is approximately matched to limit the operating current through LED 13 when the switch is turned on so as to provide a generally optimum combination of adequate illumination and adequate battery life. In the prototypes we have constructed and tested, LED 13 is a Model BR3668S, available from Stanley Electric Co., LTD. Battery 12 produces a current of approximately 25 milliamperes in LED 13. It should be appreciated that thin, long shelf life batteries other than the Renata CR1220 having different internal resistances can be used, in which case the forward voltage drop to provide proper current (typically 15–25 milliamperes) and reasonable battery life of the LED 13 should be matched according to the internal battery resistance to provide proper current (typically 15–25 milliamperes) which results in both suitable illumination by LED 13 and reasonable operating life of battery 12.

The closest prior device of which we are aware that uses the combination of only a battery and a light source includes a filament-type lamp and relies on the resistance of the filament, not the internal resistance of the battery, to limit the total current through the lamp. We are unaware of any prior art including a battery and an LED which does not also use an external resistor in series with the LED and the battery to limit the current in the LED. Use of such an external resistor would make the device much larger and more expensive, and hence impractical.

Adhesive pad 16 can be composed of solid vinyl double-sided adhesive material, available from 3M Corporation. In the prototypes we have constructed, such adhesive material is identified by Type No. 4932, and is suitable to facilitate reliable attachment to plastic and metal surfaces. It should be appreciated that the thickness and shape of adhesive pad 16 can be selected to conform to various surface features of the area of the key lead 2 or plastic overmolding thereon to which key light device 1 is to be attached.

Annular spacer 9 preferably is composed of two mil thick mylar. It should be recognized that the thickness of annular spacer 9 should be selected in order to allow the necessary amount of deformation or bending of LED lead 14 to close the switch in response to a suitable amount of switch actuation pressure being applied to switch actuation area 3. Sealing disk 8 can be composed of 3.5 mil thick vinyl having adhesive on its lower surface 20. We have used Model No. C51500, available from Spar-Cal for this purpose. We have found that the adhesive material on lower surface 20 of sealing disk 8 forms a very good seal when heated to approximately 100 degrees Celsius, using a hot air gun or oven. The heat treated sealing disk 8 provides good stabilization of upper LED lead 14. The above mentioned heat treatment and sealing of disk 8 eliminates gaps between disk 8 and the adjacent contacting surfaces of upper lead 14 and upper electrode surface 10 of battery 12 through which foreign particles might enter and interfere with reliable switch operation.

LED lead 14 typically is copper, which has a poor elastic modulus. Consequently, it is important to select the thickness of annular spacer 9 and the diameter of its hole 17 so that when pressure is applied to depress switch actuation surface 3, the switch is turned on without permanently bending upper LED lead 14.

For the structure shown in FIG. 2, flexible housing 24 can be molded of polypropylene, ABS plastic, or various commercially available molded rubber materials.

The housing 24 and/or the LED 13 may be color coded to identify the key. The case color could allow the user to easily identify a particular key when lighting is present, whereas the LED color would allow the user to identify a key at night by briefly actuating the switch. A resistive spacer indicated by dotted line 40 in FIG. 6 could be electrically attached to the bottom surface 11 of battery 12 to match or limit the current in LED 13 if the internal battery resistance is not suitably matched thereto. Alternatively, resistive material could be deposited directly on the bottom surface 11 of battery 12 to achieve the same effect.

In the above described embodiment, the thickness of battery 12 is 73 mils, the diameter of LED leads 14 and 15 is 15 mils, the thickness of adhesive pad 16 is 25 mils. The thickness of annular spacer 9 is 2 mils, and the thickness of adhesive disk 8 is 2 mils. The thickness of region 3A is 10 mils, the gap 28 between it and sealing disk 8 is 3 mils, and the depth of the recess formed by switch actuation surface 3 is 35 mils. Thus, the total thickness of key light device 1 is approximately 0.2 inches. For such a thin device, adhesive pad 16 has been found to be more than adequate in resisting the vertical components of ordinary handling faces which might tend to "peel" key light device 1 off of key head 2. The fact that the entire perimeter of key light device 1 is within the perimeter of key head 2 further helps avoidance of horizontal faces that might tend to peel key light device 1 off of or shift it sideways on key head 2.

A new suitable battery which is less than 50 mils in thickness may be available in the near future. The total thickness of the assembled key light 10 may then be reduced by 20 mils or more from the thickness of the embodiment described herein.

In one prototype, battery 12, LED 13, annular disk 9, and sealing disk 8 were assembled, and then one end of a tubular "straw" was placed over the cylindrical body of the LED. The other end of the "straw" was used as a handle to dip this assembly into a "cold" liquid vinyl coating bath and then remove and air dry it. The straw was then cut, leaving a section which defined the LED aperture 4 shown in FIG. 1. For the above cold dipped process, a wire guard ring can be placed on the top surface 19 of annular spacer 9 before sealing disk 8 is attached to thereby provide a concave surface area such as 3 which helps prevent accidental actuation of the switch.

It should be understood that upper lead 14 does not necessarily have to extend entirely across opening 17 of annular spacer 9, as shown in FIG. 3. If desired, the amount of pressure needed to actuate the switch can be reduced by shortening lead 14 approximately to the point indicated by dotted line 25 in FIG. 3. The amount of pressure required to be applied to switch actuation surface 3 to turn LED 13 on should be great enough to prevent accidental actuation during ordinary handling of key 27. It should be appreciated that the elastic modulus and diameter of lead 14, the thickness of annular spacer 9, the thickness of region 24A, the gap 28, and the elastic modulus of the material of flexible housing 24 all affect the switch actuation pressure.

Referring specifically to FIG. 4, pressure applied to switch actuation area 3 causes upper LED lead 14 to be elastically deformed downward in hole 17 of annular spacer 9 so as to electrically contact upper electrode surface 10 of battery 12, thereby causing current to flow from battery 12 through the LED 13.

Upper surface 22 of adhesive pad 16 holds lower LED lead 15 against lower electrode surface 11 of battery 12. Upper surface 23 of adhesive pad 16 attaches the assembled key light device 1 to the key head 2.

Figure 6:
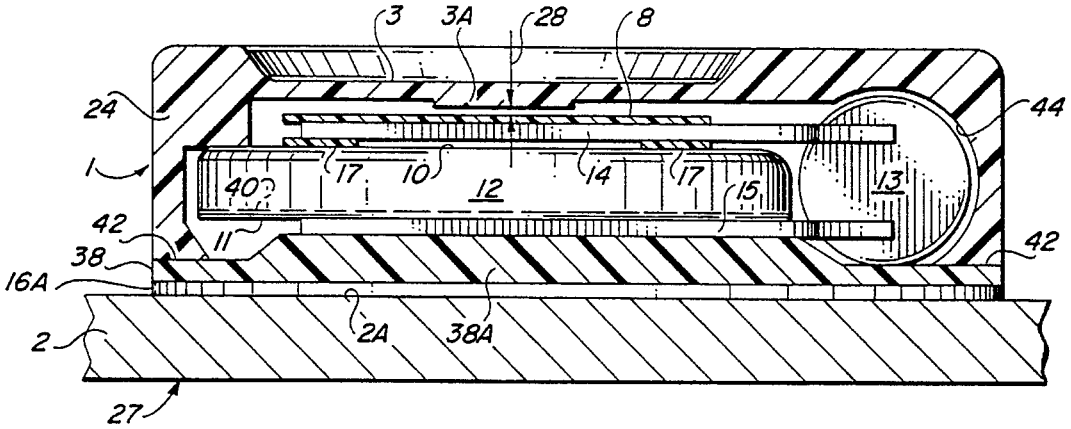
FIG. 6 is a cross-sectional view of another embodiment of the invention.

FIG. 6 shows an alternate embodiment of the invention in which the double-sided adhesive pad 16A is not provided within housing 24 and does not directly contact the bottom surface of battery 12 as in the embodiment of FIGS. 1–4. Instead, a bottom disk 38 is provided which is attached to the bottom of housing 24, for example by plastic welding or snap fit indicated by numeral 42 in FIG. 6, to seal the bottom of housing 24. A larger double-sided adhesive pad 16A is attached to the bottom surface of disk 38 and the top surface 2A of key head 2. In FIG. 6, disk 38 has a thickened central portion 38A on which the assembly including LED 13, its lower lead 15 and upper lead 14 straddling battery 12 and annular spacer 14, and flexible disk 8 are supported. LED 13 is accommodated within a semi-cylindrical void 44 within housing 24.

The above described invention thus provides a very compact key light device which is easily adhesively attached to any ordinary key or to various other objects, and which provides optimum battery life and optimum illumination.

Since the retail cost of battery 12 (which is what a user ordinarily would have to pay) is approximately three dollars, which is 60 to 100 percent of the retail price of the assembled key light 1, it clearly is practical to consider key light device 1 as being disposable. The simple structure of the described device make the low cost and disposability of key light device 2 possible.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A key light device adapted for adhesive attachment to a head of a key, comprising in combination:

(a) a disk battery having parallel conductive first and second electrode surfaces;

(b) a thin insulative annular spacer abutting the second electrode surface;

(c) a light emitting diode having a first lead extending along and electrically contacting the first electrode surface and a second lead extending along and maintained in spaced relation to the second electrode surface by the annular spacer;

(d) a double sided adhesive pad having one surface adhesively attached to the first electrode surface of the battery and another surface adapted for adhesive attachment to the head of the key; and (e) a flexible housing enclosing the battery, light emitting diode, and annular spacer, the housing having a first opening allowing escape of light emitted by the light emitting diode and a second opening exposing the adhesive pad, the housing having a flexible switch actuating surface disposed generally parallel to the second lead, whereby the second lead is elastically deformed to electrically contact the second electrode surface by a switch actuation pressure applied to the switch actuation surface and pressing the switch actuating surface toward the second conductive electrode surface.

2. The key light device of claim 1 wherein the disk battery has an internal resistance which limits a current delivered to the light emitting diode when the second lead electrically contacts the second electrode surface to a predetermined value that causes the light emitting diode to emit an adequate amount of light.

3. The key light device of claim 1 wherein the flexibility of the switch actuating surface, the thickness of the annular spacer, and an elastic modulus of the second lead have values which result in the switch actuation pressure having a value that generally avoids accidental turning on of the light emitting diode during ordinary handling of the key with the key light device adhesively attached thereto.

4. The key light device of claim 1 including a flexible disk adhesively attached to the second electrode surface and holding the second lead against the annular spacer.

5. The key light device of claim 2 wherein the adhesive pad holds the first lead against the first electrode surface.

6. The key light device of claim 1 wherein the housing is of molded plastic and includes a snap-on lip disposed around the second opening and engaging an edge of the battery to retain the housing on the key light device.

7. The key light device of claim 6 wherein the switch actuating surface is recessed from edges of the flexible housing.

8. The key light device of claim 1 including no electrical components other then the battery, the light emitting diode, and a switch formed by the second lead and the annular spacer.

9. The key light device of claim 8 wherein the switch actuating surface includes a thickened portion 3A extending toward the second lead to force it toward the second electrode surface.

10. The key light device of claim 1 wherein the thickness of the key light device is approximately 0.2 inches.

11. The key light device of claim 1 wherein the first and second leads are approximately parallel and wherein the first and second leads are bent such that each has a first section along an axis of the light emitting diode and a second section approximately perpendicular to the first section.

12. The key light device of claim 1 adhesively attached to the head of the key, a perimeter of the housing being entirely within a perimeter of the head of the key, whereby various external forces on the key light device and parallel to a plane of the key are avoided.

13. The key light device of claim 1 wherein an optical axis of the light emitting diode is aligned with a shaft of the key.

14. A method of providing an economical, disposable means of illuminating a region in front of a key, the method comprising the steps of:

(a) providing a light emitting diode which emits an adequate level of illumination when a predetermined current flows through the light emitting diode;

(b) providing a thin disk battery matched to the light emitting diode by having an internal resistance which limits current supplied by the battery to the light emitting diode to the predetermined current;

(c) electrically connecting a first lead of the light emitting diode to a first electrode surface of the battery;

(d) supporting a second lead of the light emitting diode in spaced relation to a second electrode surface of the battery;

(e) elastically deforming the second lead in response to applying of a switch actuating pressure to the second lead, thereby causing the second lead to electrically contact the second electrode surface and turn on the light emitting diode, and (f) adhesively attaching the first electrode surface of the battery to a head of the key switch, whereby light emitted by the light emitting diode travels along the shaft of the key.

15. The method of claim 14 including encapsulating the battery and light emitting diode in a flexible housing having a switch actuation surface generally parallel to the second lead and the second electrode surface, step (e) including applying the switch actuating pressure to the switch actuation surface to cause the switch actuation surface to elastically deform the second lead.

16. A key light device adapted for adhesive attachment to a head of a key, comprising in combination:

(a) a disk battery having parallel conductive first and second electrode surfaces;

(b) a thin insulative spacer abutting the second electrode surface;

(c) a light emitting diode having a first lead extending along and electrically contacting the first electrode surface and a second lead extending along and maintained in spaced relation to the second electrode surface by the spacer;

(d) a flexible housing enclosing the battery, light emitting diode, and spacer, the housing having a first opening allowing escape of light in a direction along a shank of the key emitted by the light emitting diode and a second opening on the bottom thereof, the housing having a flexible switch actuating surface disposed generally parallel to the second lead, whereby the second lead is elastically deformed to electrically contact the second electrode surface by a switch actuation pressure applied to the switch actuation surface and pressing the switch actuating surface toward the second conductive electrode surface;

(e) a bottom cover attached to the bottom of the housing to cover the second opening and support the disk battery, the light emitting diode, and the spacer within the housing; and (f) a double sided adhesive pad having one surface adhesively attached to a bottom surface of the bottom cover and another surface adapted for adhesive attachment to the head of the key.

17. The key light device of claim 16 wherein the flexibility of the switch actuating surface, the thickness of the spacer, and an elastic modulus of the second lead have values which result in the switch actuation pressure having a value that avoids accidental turning on of the light emitting diode during ordinary handling of the key with the key light device adhesively attached thereto.

18. The key light device of claim 16 wherein the spacer is annular, the key light device including a flexible disk adhesively attached to the spacer and holding the second lead against the spacer.

19. The key light device of claim 18 wherein the switch actuating surface includes a thickened portion 3A extending toward the second lead to force it toward the second electrode surface.

* * * * *